United States Patent [19]

Cairns et al.

[11] 4,330,372

[45] May 18, 1982

[54] COKE OVEN EMISSION CONTROL METHOD AND APPARATUS

[75] Inventors: Donald F. Cairns, Webster Groves, Mo.; Daniel J. Metzger, Belleville, Ill.

[73] Assignee: National Steel Corporation, Pittsburgh, Pa.

[21] Appl. No.: 268,253

[22] Filed: May 29, 1981

[51] Int. Cl.[3] ..... C10B 27/00; C10B 33/00; C10B 41/02

[52] U.S. Cl. ..... 201/41; 202/263

[58] Field of Search ..... 201/41; 202/263, 270; 266/157–159; 414/212

[56] References Cited

U.S. PATENT DOCUMENTS

| | | | |
|---|---|---|---|
| 3,630,852 | 12/1971 | Nashan et al. . | |
| 3,697,381 | 10/1972 | Kemmetmueller . | |
| 3,716,457 | 2/1973 | Schon . | |
| 3,746,626 | 7/1973 | Morrison . | |
| 3,809,619 | 5/1974 | Drebes et al. . | |
| 3,844,901 | 10/1974 | Roe et al. | 202/263 |
| 3,879,267 | 4/1975 | Nashan et al. | 202/263 |
| 3,930,961 | 1/1976 | Sustarsic et al. | 202/263 |
| 3,937,656 | 2/1976 | Pries et al. | 202/262 |
| 3,972,780 | 8/1976 | Calderon | 202/263 |
| 3,972,782 | 8/1976 | Patton | 202/263 |
| 4,050,992 | 9/1977 | Still et al. | 202/263 |
| 4,053,366 | 10/1977 | Holter | 202/263 |
| 4,111,757 | 9/1978 | Ciarimboli | 202/263 |

*Primary Examiner*—Bradley Garris

*Attorney, Agent, or Firm*—Paul T. O'Neil; James L. Bean

[57] ABSTRACT

A substantially closed shed cooperates with the coke discharge end of a coke oven battery to enclose the quench car tracks and coke guide tracks along the entire length of the battery and extends to the quenching tower for confining both the large volume of particulate and gaseous emissions released during pushing of coke and the substantially smaller volume of fugitive emissions escaping around the oven doors substantially throughout the coking operation. A first exhaust conduit extends along and opens into the top of the gabled roof of the coke shed along substantially its full length, and a plurality of offtake conduits provide fluid communication from the first exhaust duct at spaced intervals along its length with a main exhaust duct. Dampers in the duct system are operable to provide differential evacuation zones along the length of the shed to maximize evacuation in the area of pushing and thereby reduce the total power requirements necessary to adequately evacuate pushing emissions from the enclosed shed, and to reduce the total volume of air exhausted and consequently the power required when the ovens are not being pushed.

23 Claims, 7 Drawing Figures

COKE OVEN EMISSION CONTROL METHOD AND APPARATUS

BACKGROUND OF THE INVENTION

1. Field of the Invention

This invention relates to coke oven emission control apparatus and to the method of operating such apparatus, and more particularly to apparatus for and methods of capturing and controlling particulate and gaseous emissions produced during the production of coke in and the pushing of coke from a battery of coal coking ovens.

2. Description of the Prior Art

The production of coke has always presented serious air pollution problems. Polluting emissions escape during all phases of the coking operation, from the charging of coal into the hot ovens, through the coking process, during pushing of coke from the ovens into quench cars for cooling, and during transportation in the quench cars to the quenching station. The major portion of metallurgic coke used today is produced in recovery type ovens which are operated at a slight positive internal pressure and as a result there is a tendency for the hot, gaseous distillation products or fumes to escape, particularly around the oven doors which are extremely difficult to seal. The incomplete combustion of such escaping fumes in the atmosphere results in substantial particulate and gaseous pollutants in the atmosphere.

As incandescent coke is pushed from an oven through a coke guide into a waiting quench car, the coke mass breaks up in the atmosphere. As the incandescent coke breaks, violent burning takes place and large volumes of high temperature gases are quickly released. The rapidly generated and expanding gases carry substantial volumes of particulate matter into the atmosphere. This burning continues, although at a somewhat reduced rate, in the quench car until the coke is cooled or quenched, conventionally in a quench tower constructed adjacent one end of the oven battery.

The numerous prior art enclosures for controlling cokeside emissions have not been entirely satisfactory for various reasons. For example, the early coke side sheds were generally constructed with relatively small internal volume so that substantial emission leakage occured as a result of the rapid expansion of gases during pushing. Further, the relatively heavy, heat resistant structures were generally supported at least in part on the oven structure, placing undesirable loads on the ovens which are, of necessity, operated under extremely high temperature conditions. Attempts to withdraw pushing emissions uniformly along the full length of the shed have similarly resulted in the escape to substantial quantities of polluting emissions in the vicinity of the quench car. To overcome this problem attempts have been made to direct the entire exhaust to the area of the oven being pushed, or into the area of the quench car as it is moved along the ovens. However, these attempts have not been entirely satisfactory, and also failed to adequately control fugitive emissions during coking, or have required operation of excessive exhaust equipment, and a consequent waste of energy, during periods when ovens were not being pushed.

U.S. Pat. No. 3,630,852 discloses a shed structure enclosing the coke side of an oven battery, with the roof of the shed resting on the endwall of the battery and with an exhaust pipe leading from one endwall of the shed into the quenching tower to permit the escape of emissions from the shed into the tower beneath a water spray. This coke side shed has not proved satisfactory in that all emissions were forced to flow from the closed shed through one outlet in the endwall of the shed. Further, supporting the shed roof on the oven wall places substantial loads on both the shed and the oven structure as a result of thermal growth and contraction of the two structures.

U.S. Pat. No. 3,844,901 discloses a coke side shed which projects substantially above the oven battery and has an enlarged cross section at its top to provide increased capacity for emissions. An exhaust duct extending the full length of the shed at its top, has spaced air scoops to meter the flow of emissions into the duct in such a manner as to provide a uniform pressure within the duct along the full length of the shed. However, the generation of large volumes of emissions at one point within the shed during pushing of an oven could result in spilling of the emissions around the bottom edge of the sidewall of the shed before such emissions could distribute themselves for withdrawal along the full length of the shed in the enlarged top portion.

U.S. Pat. No. 3,937,656 discloses the coke side shed in which the major portion of the weight of the roof structure is supported, in cantilevered fashion, from a vertical girder spaced outboard of the quench car tracks. The rigid structure is, nevertheless, secured to the endwall of the ovens so that thermal expansion and contraction of the oven structure could place substantial load on this support. An exhaust pipe is provided for removing the emissions from the shed, and an inlet 17 can be automatically regulated by a control element, presumably a valve.

U.S. Pat. No. 3,879,267 discloses a coke side shed structure for controlling emissions, and contains a statement that, in an alternate arrangement, the shed roof is designed so that it is supported solely by the wall of the shed remote from the battery. The manner in which this is accomplished is not described.

U.S. Pat. No. 4,053,366 discloses a coke side emission control shed structure which includes an exhaust duct 26 mounted outside of and extending along the shed, with a plurality of branch pipes connected between the primary exhaust duct and the exhaust shed at spaced intervals. Remotely controlled valves in the branch pipes are operated to open only those valves above a car containing hot coke either during pushing or during transport to the quenching tower. This main exhaust system is used only to control quenching emissions, and a separate exhaust system is provided to remove fugitive emissions escaping from the doors during the coking operation.

U.S. Pat. No. 3,716,457 discloses a coke side shed structure having a plurality of partition walls positioned above the quench car track, and an elongated vertical movable wall mounted on the coke guide is adapted to cooperate with the partition walls to form an enclosed compartment above a quench car during the pushing operation. A main exhaust duct extends outside the shed and a plurality of short pipes opening one into each compartment are connected to the main exhaust duct to remove emissions from the respective chambers. Valves are provided in the branch pipes. The coke shed is spaced from the oven battery and emissions are confined only when the quench car is adjacent the coke guide. No means are provided for withdrawing fugitive emissions by the exhaust system.

U.S. Pat. No. 3,746,626 discloses a coke side emission control system including a shed having an exhaust duct extending along its roof and having a plurality of valve-controlled inlets from the shed into the exhaust duct at spaced intervals along its length. The valves are opened and closed by the quench car moving along the tracts to direct the exhaust to those inlets above the quench car. Baffle walls in the shed are intended to confine the emissions to the area of the quench car.

SUMMARY OF THE INVENTION

While at least some of the prior art coke side emission control apparatus have greatly reduced emissions, present air pollution control standards require that such emissions be further reduced. Further, the current energy shortage and the high cost of such energy makes it essential that such apparatus operate as efficiently as possible. Accordingly, it is the primary object of the present invention to provide an improved coke side shed and emission control apparatus, and a method of operating such apparatus, which overcomes many of the defects of the prior art discussed above and which efficiently and economically controls coke side emissions during both coking and pushing operations.

Another object of the invention is to provide an improved coke side shed and emission exhausting apparatus which enables the application of maximum exhaust in the area of pushing while maintaining a reduced exhaust along substantially the entire remainder of the length of the shed.

Another object of the invention is to provide an improved coke side emission control shed which provides an efficient emission seal with the endwall of a coke oven battery without applying excessive loads to the battery and which employs an exhaust system capable of simultaneously withdrawing a large volume of gases along a selected zone within the shed and of withdrawing a lesser volume of emissions along the remainder of the shed.

In the attainment of the foregoing and other objects and advantages of the invention, an important feature resides in providing a coke side shed which is self-supporting and which cooperates with the coke side battery wall to enclose the guide car and quench car tracks. The shed extends a substantial distance above the top of the oven battery and has a peaked, or gabled roof opening at its peak into a large diameter zoning exhaust duct which extends along the full length of the shed. A main exhaust duct extends generally parallel to the zoning duct outside the shed and along at least a substantial portion of the length of the zoning duct, and a plurality of offtake ducts connect the zoning duct with the main exhaust at spaced intervals along the shed. Valves, or dampers, in the duct system are operable to selectively control the flow through the offtakes to direct the maximum exhaust to selected areas in the zoning duct and the corresponding portion of the shed while maintaining a continuous but reduced exhaust flow from the remainder of the zoning duct during pushing of the ovens and during transport of coke from the oven battery to the quenching tower. The selectively operable valves are also operable to maintain a reduced exhaust flow throughout the length of the shed during periods when pushing is not taking place to thereby substantially reduce the volume of air withdrawn from the shed and to consequently substantially reduce the total energy requirement of the apparatus.

In accordance with one embodiment of the invention, selectively operable baffles which are capable of restricting but not completely stopping airflow are mounted in the zoning duct. In accordance with another embodiment, permanent baffles which may totally or only partially block airflow, are mounted in and permanently divide the zoning duct into a plurality of separate exhaust zones. An offtake duct having a selectively operable valve is connected between the main exhaust duct and each such separate zone. Also, partition walls may be provided in the top portion of the shed to reduce the longitudinal flow of emissions in the shed, especially during pushing. The combination of the interior baffle walls and the maximum exhaust effort being directed to the area of pushing enables efficient removal of the emissions without requiring excessive energy. At the same time, continued exhaust at a reduced rate throughout the shed provides for efficient and effective emission control.

BRIEF DESCRIPTION OF THE DRAWINGS

The foregoing and other objects and advantages of the invention will become apparent from the detailed description contained hereinbelow, taken in conjunction with the drawings, in which.

DESCRIPTION OF THE PREFERRED EMBODIMENTS

Figure 1:
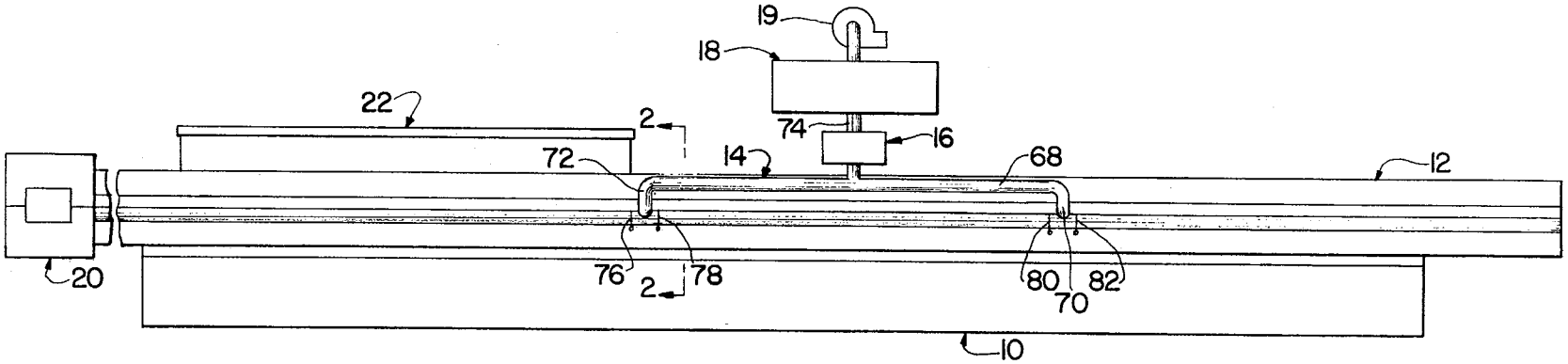
FIG. 1 is a top plan view of a coal coking installation embodying an improved emission control apparatus according to the present invention.
Figure 4:
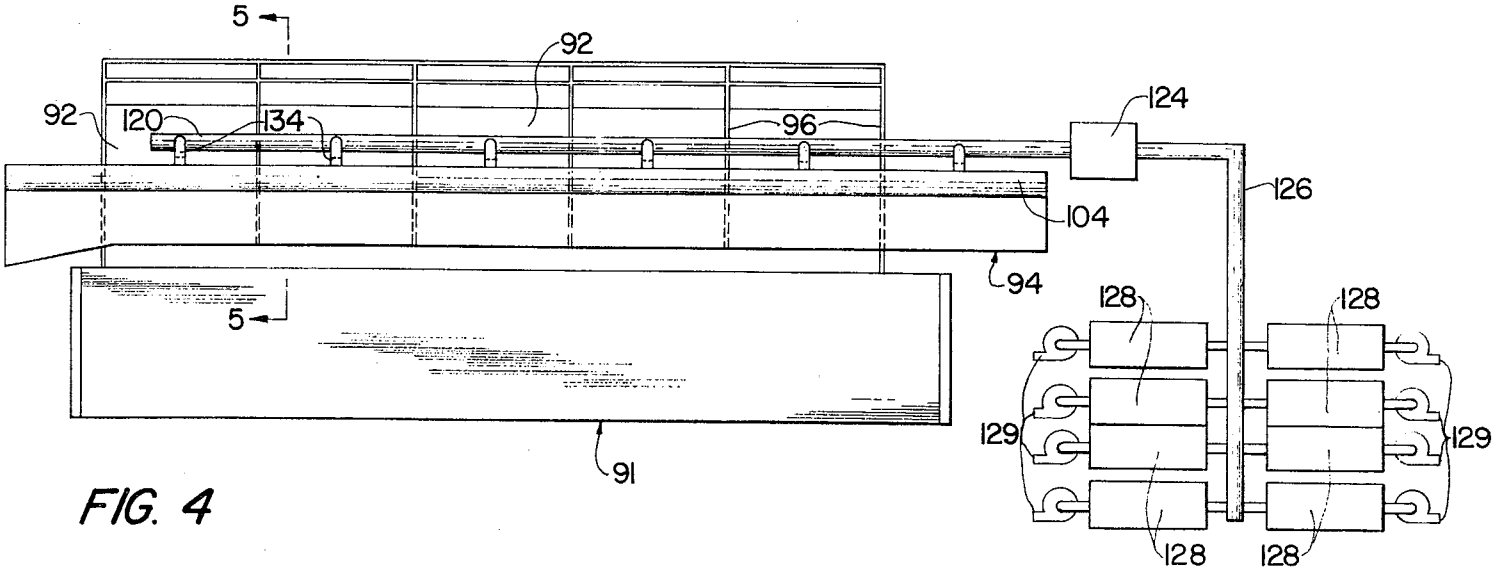
FIG. 4 is a top plan view of an alternate embodiment of the invention.

Referring now to the drawings in detail, a single coke oven battery is schematically illustrated in FIG. 1 and designated generally by the reference numeral 10, it being understood that this battery may actually comprise a plurality of separate batteries constructed in a row. The emission control apparatus according to the present invention includes an elongated shed structure 12 extending along the coke side of battery 10. An exhaust duct system indicated generally by the reference numeral 14 is provided to withdraw air and emissions from inside the shed through a spark arrestor 16 and an air cleaning apparatus such as a baghouse 18 by use of a suitable induced draft system indicated schematically at 19.

Shed 12 extends past the ends of the battery 10 to permit a quench car and the necessary equipment associated therewith to be moved past the battery of ovens while still remaining within the shed. The shed 12 is connected at one end to a conventional quenching tower 20, and a coke wharf 22 may be constructed along a portion of the quench car tracks in a conventional manner in position to receive quenched coke from the quench cars after the cars are removed from the quenching tower 20.

Figure 2:
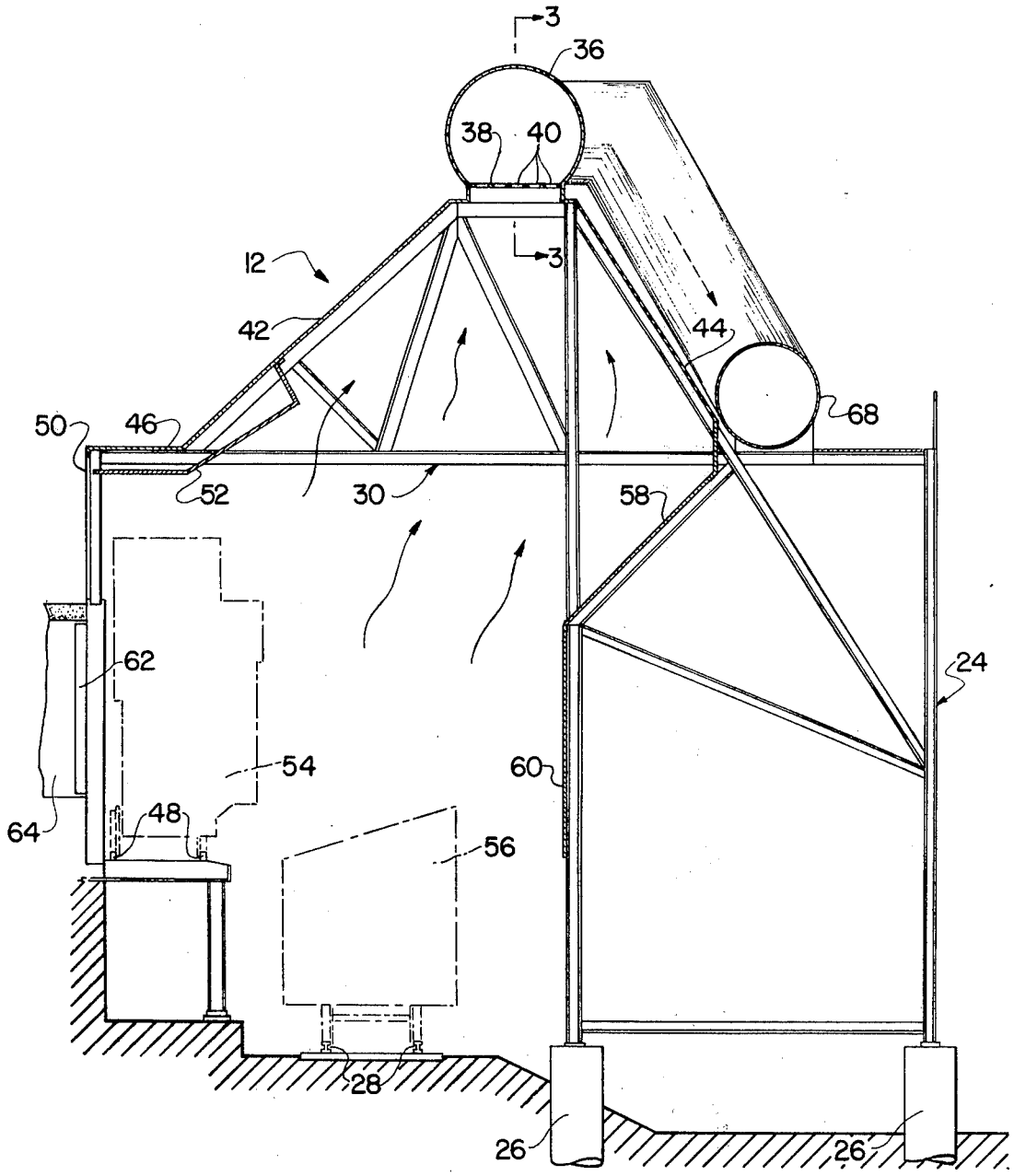
FIG. 2 is an enlarged view taken on line 2—2 of FIG. 1.

Referring to FIG. 2 it is seen that shed 12 comprises a structural steel frame assembly 24 supported on and extending upwardly from foundation blocks 26 in outwardly spaced relation to the quench car tracks 28. A laterally projecting truss assembly 30 is supported on the top portion of vertical frame 24 and extends inward toward the oven battery to support the roof of the shed and the evacuation duct system 14. The roof projects substantially above the top of the oven battery.

Roof truss 30 supports at its peak a large diameter zoning duct 36 which is open along its entire length into the interior of the shed 12. Duct 36 is preferably in the form of a cylindrical pipe having approximately a quarter section removed at its bottom, and a metering plate 38 extends over this removed section. A plurality of openings 40 are formed in plate 38 in a fixed pattern extending substantially over its full area, with the openings 40 providing a restricted flow into the interior of the zoning duct for reasons pointed out more clearly hereinbelow. A pair of roof panels 42, 44 extend downwardly and outwardly from the zoning duct 36 and are supported on the truss 30. A plate 46 extends in a generally horizontal direction from the bottom edge of roof panel 42 over the coke guide tracks 48 and terminates at a position substantially vertically above the coke side endwall of the ovens. A vertical wall member 50 supported on the distal end of the truss members 30 projects downwardly and forms a seal between the top of the oven walls, at the coke side of the battery, and the plate 46.

A heat shield 52 is supported on the truss 30 and extends in downwardly spaced relation to the plate 46 and the lower edge portion of roof panel 42 to protect the roof from the intense heat of coke being pushed through a guide car 54 supported on tracks 48 into the quench car 56 and to impart a rolling motion to the gases maximizing the use of the storage volume of the shed enclosure.

The sidewall of the shed includes a downwardly and inwardly inclined panel 58 connected to the bottom edge of roof panel 44, and a vertically extending panel 60 supported on the frame 24 and spaced outwardly from the guide car tracks. Roof panel 44 and the inclined sidewall panel 58 cooperate to provide an increased volume, or expansion chamber in the top portion of the shed.

Sidewall 60 extends to a level spaced below the bottom of the removable doors 62 of the individual ovens 64, and below the open top of the quench cars 56, but terminates above the ground surface so that outside air can enter the shed beneath this wall along its full length. Also, an endwall is provided on the shed on the end thereof which does not connect with the quenching tower. The endwall (not shown) may also terminate at a level corresponding to the bottom edge of wall panel 60 and preferably has door means to permit the quench car and guide car to be moved on their tracks to a position outside the shed as is conventional in coke side shed construction.

Figure 3:
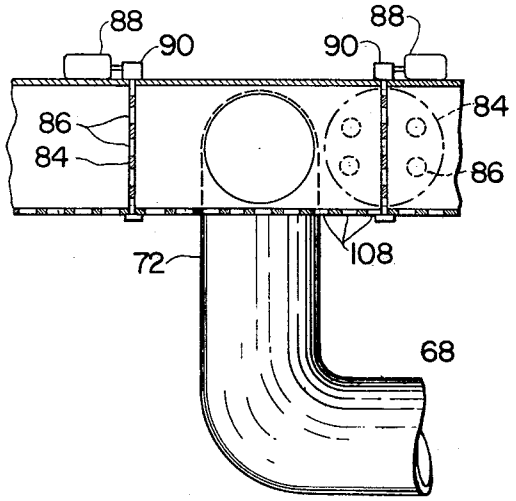
FIG. 3 is a fragmentary sectional view taken on line 3—3 of FIG. 2.

An exhaust main 68 is supported on the frame structure 24 outboard of the roof panel 44. Exhaust main 68 extends below and generally parallel to the zoning duct 36. Exhaust main 68 has its opposed ends connected, through offtakes 70, 72, to zoning duct 36 at points spaced from the ends of the coke battery 10 which are approximately one third the length of the battery. The central portion of exhaust main 68 is connected, through a suitable duct 74 to the bag house 18, with the fan 19 being connected in the duct 74. A pair of flow regulating dampers, or valves 76, 78 are mounted in the zoning duct 36, one on each side of offtake 72 and a second pair of such valves 80, 82 are mounted one on each side of offtake 70. The damper valves are identical and like reference numerals will be used to designate corresponding parts of the various valves. Thus, as shown in FIG. 3, the flow regulating valve 74 may comprise a movable butterfly valve element 84 having a plurality of openings 86 formed therein. Suitable means such as the motors 88 and reduction gear drives 90 are provided to move the valve elements 84 from the fully closed position shown in solid lines in FIG. 3 to the open position shown in broken lines.

When all of the valves 76, 78, 80 and 82 are in the fully closed position, the flow of air and emissions through the openings in metering plate 38 and zoning duct 36 into the exhaust main 68 will be substantially restricted so that less power will be required to operate the exhaust system. While a single exhaust fan 19 is schematically illustrated in FIG. 1, preferably a plurality of separate fans are used with each fan being connected to a separate gas cleaning device in the bag house illustrated schematically at 18. The use of a plurality of exhaust fans makes it possible, during periods of low emission generation in the shed, to shut down selected ones of the exhaust fans while continuing to operate others at their most efficient level. During pushing of the ovens, when maximum emissions are released in the shed, all exhaust fans can be operated to produce maximum airflow. Of course, when only minimum airflow is desired throughout the emission control shed, all valves in the zoning duct may be closed to provide a reduced but substantially uniform flow from the shed into the zoning duct. The metering plate 38 acts to limit flow into the zoning duct so that vacuum applied through the offtakes 70, 72 will result in a substantially uniform flow into the zoning duct along the full length of the shed.

During pushing of the ovens, large volumes of emissions are released at a single point within the shed. To efficiently remove these emissions, the flow restricting or zoning valve nearest the oven being pushed is moved to its fully open position and all exhaust fans are operated so that maximum evacuation is effected in the pushing area. At the same time, reduced evacuation continues throughout the remaining portion of the shed. By rapidly exhausting emissions in the area of pushing, the major portion of the emissions are quickly evacuated. By providing relatively large zones such as the three zones for a large battery of ovens, the pushing emissions can expand over the substantial portion of the shed which is being rapidly evacuated so that expansion into the remaining zones is minimal. However, any emissions expanding into such zones of lower evacuation are nevertheless evacuated so that the emissions do not spill out around the bottom edge of the shed wall 60.

Preferably the zoning valves are automatically controlled in response to signals such as radio signals from the coke guide car which is always positioned at the area of greatest emission concentration during the pushing operation. Although some burning continues to take place in the quench car during movement to the quenching tower, this burning is at a substantially lower rate and movement to the quench tower is relatively rapid so that emissions released even in zones of reduced evacuation are adequately removed.

Referring now to FIGS. 4–7, an alternate embodiment of the coke side emission control apparatus is illustrated in use with a relatively short coke oven battery 91 having a coke receiving wharf 92 extending substantially along its full length in outwardly spaced relation to the quench car tracks. Again, it should be apparent that the size of the oven battery or batteries with which the invention is used is immaterial and this embodiment could be used with the larger battery illustrated in FIG. 1. Accordingly, like reference numerals are employed to designate corresponding part of the oven structure and coke handling apparatus in both of the illsutrated embodiments. In the second embodiment the coke side shed, designated generally by the reference numeral 94, is supported by an open steel framework 96 extending upwardly above the quench wharf 92 and supported on foundation blocks 98. The shed enclosure projects laterally from vertically extending structural columns 100 of the frame 96 and is supported by a structural steel frame work, shown in broken lines in FIG. 5, rigidly connected with the top portion of such columns. The shed includes a vertical wall panel 102 mounted on columns 100 and extending from a point spaced below the bottom of ovens 64 to the entrance of zoning duct 104 at the top portion of the shed. As in the previous embodiment, zoning duct 104 is preferably in the configuration of a cylindrical pipe having a segment of its wall removed at its bottom to define an entrance into the duct. A metering plate 106, having a pattern of metering openings 108 extending generally over its entire surface controls the flow of air and emissions into the zoning duct as described above.

An inclined roof panel 110 extends downwardly from the zoning duct 104 in the direction of the oven battery 91 to a position generally adjacent the gas collecting main 112 which is supported on a platform 114 mounted on the oven buck stays 116 in conventional manner. A vertical wall panel 118 extends downward from roof panel 110 and forms a seal with the top surface of platform 114 to complete the enclosure in cooperation with the coke side endwall of the oven battery.

A main exhaust duct 120 is supported on the shed frame 96, as by suitable platforms 122, and extends substantially along the full length of the shed parallel to and spaced below the zoning duct 104. Main exhaust duct 120 has one end connected to a spark arrestor 124 having its discharge connected, through a suitable conduit 126 to a plurality of gas cleaning devices indicated schematically at 128. In an actual installation, separate exhaust fan means 129 are preferably employed, one with each of the plurality of gas cleaning devices, for more economical utilization of power and of the gas cleaning apparatus.

Figure 6:
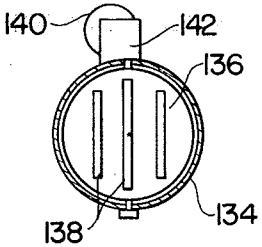
FIG. 6 is a sectional view taken on line 6—6 of FIG. 5.
Figure 7:
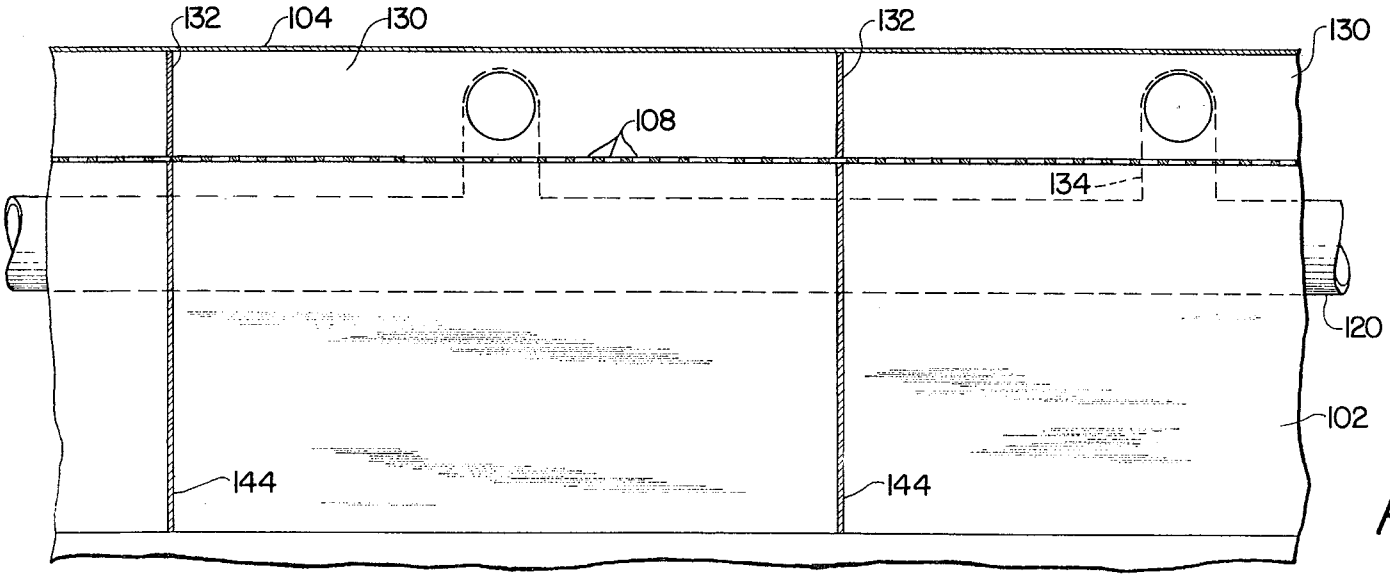
FIG. 7 is an enlarged sectional view taken on line 7—7 of FIG. 5.

The zoning duct 104 is divided into a plurality of elongated sections or zones 130 by divider plates 132 rigidly mounted within the duct at spaced intervals along its length. Each section is connected by an offtake duct 134 to the main exhaust duct 120. A damper valve 136 is mounted in each offtake duct 134 to control the flow of air and emissions from the respective zoning duct section to the exhaust main. As shown in FIG. 6, damper valves 136 are provided with openings, or bypass means 138 so that they permit a reduced gas flow therethrough when in the closed position. Damper valves 136 are moved between the open and closed positions by suitable motor means 140 acting through the reduction gear schematically illustrated at 142. Preferably the respective motors are remotely controlled as by radio signals from a transmitter in the coke guide car as described above in relation to the embodiment of FIGS. 1–3.

Figure 5:
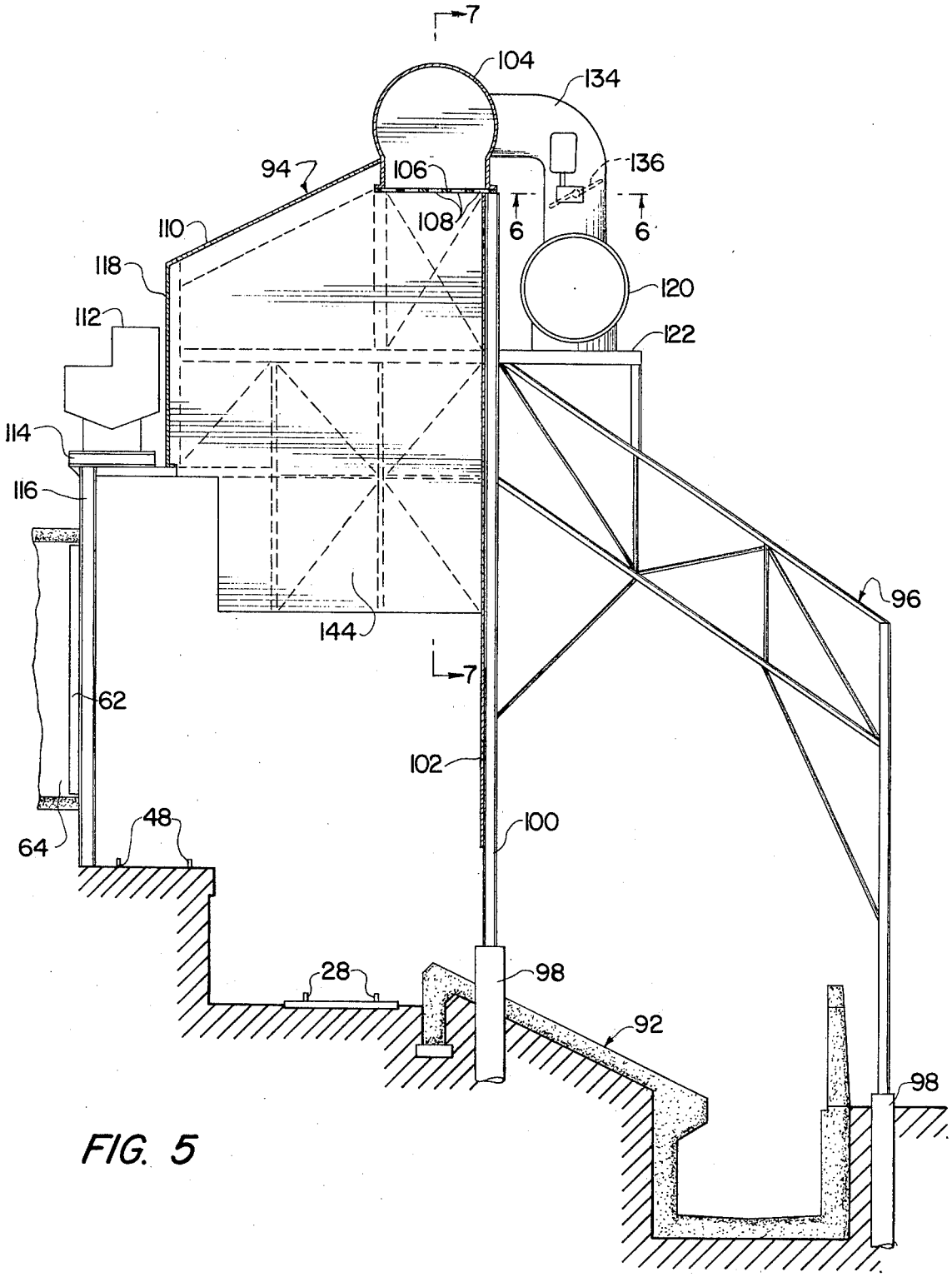
FIG. 5 is an enlarged sectional view taken on line 5—5 of FIG. 4.

As seen in FIG. 5, the shed 94 projects a substantial distance above the top of the coke ovens 64 to provide a large volume for gas expansion within the shed during pushing of coke. The top portion of this enclosed space is divided into zones corresponding to the respective zones 130 of zoning duct 104, by downwardly projecting partition panels 144. The bottom edge of each panel 144 is spaced above the open top of the quench car and of the coke guide so as not to interfere with their free movement through the shed. Also, the bottom edge of the panels 144 are spaced substantially above the bottom edge of wall 102 to permit expansion of gases from one zone of the shed to another, around the bottom of the panels 144 without hot emissions and gases escaping beneath the wall 102.

In operation of the emission control system of this embodiment, during the coking operation and when the ovens are not being pushed, the damper valves 136 in all of the offtake pipes 134 may be closed to restrict the flow of air from the respective zoning pipe sections to thereby reduce the total airflow and consequently the energy required to evacuate fugitive emissions escaping around the oven doors. The metering plate 106 in the bottom opening of zoning duct 104 assured that emissions will enter each zone of the zoning duct along substantially its full length to effectively and efficiently evacuate emissions from the shed.

During pushing of an oven, when large volumes of gases rapidly expand into the shed in the vicinity of the oven being pushed, the damper valve is fully opened in the offtake leading to that zone of the zoning duct and the corresponding zone of the shed to provide maximum evacuation from that portion of the shed. If desired, the damper valve in the adjacent offtake duct, or ducts, may be fully or partially opened to increase the exhaust flow from these sections and thereby more rapidly remove any emissions or gases which may expand around the bottom edge of the partition panel 144. Even without opening the adjacent damper valves, however, evacuation at a reduced rate will continue throughout the length of the shed to efficiently and effectively remove emissions while avoiding the necessity of removing excessive volumes of air throughout the full length of the shed. The partition panels 144 assist in preventing the expansion of the hot pushing emissions throughout the full length of the oven and thereby permit more rapid and efficient evacuation of such pushing emissions.

Although not specifically illustrated, it is believed apparent that endwalls would also be used on this embodiment of the shed. Further, the shed extends beyond the end of the oven battery at one end to permit equipment to be removed from in front of the battery wall and at the other end to connect with the quenching tower, not shown.

It is believed apparent that various modifications to the invention could readily be made. Thus, while preferred embodiments have been disclosed and described, it should be understood that the invention is not so limited but rather that it is intended to include all embodiments of the invention which would be apparent to one skilled in the art and which come within the spirit and scope of the invention.

We claim:

1. An emission control system for use in connection with a coal coking installation including a plurality of elongated coke ovens having removable doors at their opposed ends and being constructed in side by side relation in a battery having a pushing side and a coke side, a coke guide movable over tracks extending along the coke side of the battery for guiding coke pushed from an oven, and an open topped quench car for receiving incandescent coke from the coke guide, the quench car being supported on tracks extending along the coke side of the battery below and spaced outwardly from the coke guide tracks, the emission control system comprising, an elongated shed extending along the full length of the coke side of the battery and enclosing the coke side of the battery, the coke guide tracks, and the quench car tracks to capture and contain emissions from coke being pushed from the ovens and emissions escaping from the oven doors at the coke side of the battery during the coking process, said shed including a sidewall spaced outwardly from the quench car tracks and having a bottom edge located below the level of the coke ovens and the open top of the quench car and spaced above the ground to permit air to enter the shed, and a roof spaced substantially above the top of the ovens, said roof having a peak and an inclined panel extending downwardly from said peak in the direction of said ovens, a zoning duct supported above said roof and extending along said peak substantially the full length of said shed, said zoning duct having an inlet opening extending substantially its full length and communicating with the interior of said shed along said peak, a main exhaust duct extending generally parallel to said zoning duct, exhaust fan means connected with said main exhaust duct for inducing a flow of air through the main exhaust duct, a plurality of offtake ducts connected between said main exhaust duct and said zoning duct at spaced points along the zoning duct, and damper valve means associated with one of said ducts and operable to selectively restrict the flow of air and emissions through each of said offtake ducts to vary the flow of air and emissions from said shed through said zoning duct, said offtake ducts, and said main exhaust duct under influence of said exhaust fan means along the length of said shed.

2. The emission control system defined in claim 1 wherein said damper valve means comprises a selectively operable damper located in each said offtake duct.

3. The emission control system defined in claim 1 wherein said damper valve means comprises a valve member movable between an open position permitting free flow therethrough and a closed position, and bypass means permitting limited flow therethrough.

4. The emission control system defined in claim 1 further comprising a plurality of partition walls mounted in and extending generally transversely of said shed, said partition walls dividing at least the portion of the shed above said ovens into a plurality of open bottomed zones.

5. The emission control system defined in claim 1 wherein said shed comprises a structural steel frame extending upwardly along and outboard of said sidewall, said steel frame supporting substantially the entire weight of said roof, said zoning duct, said offtake ducts and said main exhaust duct.

6. The emission control system defined in claim 1 further comprising flow restricting means extending over said inlet opening for restricting flow of air and emissions from said shed into said zoning duct.

7. The emission control system defined in claim 6 wherein said flow restricting means comprises elongated plate means having a substantially uniform pattern of openings extending therethrough and extending over its surface throughout substantially the full length of said shed.

8. The emission control system defined in claim 1 wherein said damper valve means comprises a plurality of damper valves mounted in said zoning duct one on each side of and adjacent to each offtake duct.

9. The emission control system defined in claim 8 further comprising flow restricting means extending over said inlet opening for restricting flow of air and emissions from said shed into said zoning duct.

10. The emission control system defined in claim 9 wherein said shed comprises a structural steel frame extending upwardly along and outboard of said sidewall, said steel frame supporting substantially the entire weight of said roof, said zoning duct, said offtake ducts and said main exhaust duct.

11. The emission control system defined in claim 1 further comprising a plurality of fixed baffles mounted in and dividing said zoning duct into a plurality of evacuation zones, and wherein one of said offtake ducts is connected between each said evacuation zone of said zoning duct and said main exhaust duct.

12. The emission control system defined in claim 11 wherein said damper valve means comprises a selectively operable damper located in each said offtake duct.

13. The emission control system defined in claim 12 further comprising a plurality of partition walls mounted in and extending generally transversely of said shed, said partition walls dividing at least the portion of the shed above said ovens into a plurality of open bottomed zones.

14. The emission control system defined in claim 12 wherein said shed comprises a structural steel frame extending upwardly along and outboard of said sidewall, said steel frame supporting substantially the entire weight of said roof, said zoning duct, said offtake ducts and said main exhaust duct.

15. The emission control system defined in claim 12 further comprising flow restricting means extending over said inlet opening for restricting flow of air and emissions from said shed into said zoning duct.

16. The emission control system defined in claim 12 wherein said damper valve means comprises a valve member movable between an open position permitting free flow therethrough and a closed position, and bypass means permitting limited flow through the valve in the closed position.

17. The emission control system defined in claim 16 further comprising a plurality of partition walls mounted in and extending generally transversely of said shed, said partition walls dividing at least the portion of the shed above said ovens into a plurality of open bottomed zones.

18. The emission control system defined in claim 17 wherein said shed comprises a structural steel frame extending upwardly along and outboard of said sidewall, said steel frame supporting substantially the entire weight of said roof, said zoning duct, said offtake ducts and said main exhaust duct.

19. The emission control system defined in claim 18 further comprising flow restricting means extending over said inlet opening for restricting flow of air and emissions from said shed into said zoning duct.

20. A method of controlling emissions from a coal coking installation including a plurality of elongated coke ovens having removable doors at their opposed ends and being constructed in side by side relation in a battery having a pushing side and a coke side, a coke guide movable over tracks extending along the coke side of the battery for guiding coke pushed from an oven, an open topped quench car for receiving incandescent coke from the coke guide, the quench car being supported on tracks extending along the coke side of the battery below and spaced outwardly from the coke guide tracks, the method comprising the steps of, providing an elongated shed extending along the full length of the coke side of the battery and enclosing the coke side of the ovens, the coke guide tracks, and the quench car tracks to capture and contain emissions from coke being pushed from the ovens and emissions escaping from the oven doors at the coke side of the battery during the coking process, the shed having a peaked roof, supporting a zoning duct above the roof peak with the zoning duct extending along the peak substantially the full length of said shed, and providing fluid communication between the shed and the zoning duct throughout substantially their full length, providing a main exhaust duct extending generally parallel to the zoning duct and connected with exhaust fan means to induce a flow of air through the main exhaust duct, connecting the zoning duct and the main exhaust duct through a plurality of offtake ducts at spaced points along their length, and selectively restricting the flow of air and emissions through each of the offtake ducts to vary the flow of air and emissions from the shed through the zoning duct, the offtake ducts, and the main exhaust duct under influence of the exhaust fan means to thereby vary the rate of withdrawal of emissions along the length of the shed.

21. The method defined in claim 20 wherein the step of selectively restricting the flow of air and emissions through each of the offtake ducts comprises establishing a high rate of flow from the top of the shed into the zoning duct in the area of the shed where coke is being pushed from an oven, and simultaneously establishing a lower rate of flow into the zoning duct from areas of the shed remote from the area where coke is being pushed.

22. The method defining in claim 21 wherein the step of selectively restricting the flow of air and emissions through each of the offtake ducts comprises providing damper valves in each offtake duct, and selectively moving the damper valves between a first position permitting free flow therethrough and a second position permitting restricted flow therethrough.

23. The method defined in claim 21 wherein the step of selectively restricting the flow of air and emissions through each of the offtake ducts comprises providing a plurality of damper valves in the zoning duct, and selectively moving the damper valves between a first position permitting substantially free flow of air therethrough and a second position restricting the flow of air therethrough.

* * * * *